US008690640B2

(12) United States Patent
Johannessen

(10) Patent No.: US 8,690,640 B2
(45) Date of Patent: Apr. 8, 2014

(54) COMPLEX GEOGRAPHICAL EDGE POLISHING

(75) Inventor: Thomas Johannessen, Fjerdingby (NO)

(73) Assignee: Apple Inc., Cupertino, CA (US)

( * ) Notice: Subject to any disclaimer, the term of this patent is extended or adjusted under 35 U.S.C. 154(b) by 759 days.

(21) Appl. No.: 12/833,923

(22) Filed: Jul. 9, 2010

(65) Prior Publication Data

US 2011/0081837 A1 Apr. 7, 2011

Related U.S. Application Data

(60) Provisional application No. 61/249,200, filed on Oct. 6, 2009.

(51) Int. Cl.
*B24B 7/07* (2006.01)
*B24B 9/00* (2006.01)

(52) U.S. Cl.
USPC ..... 451/66; 451/44; 451/57; 451/67; 451/190; 451/194; 451/262; 451/362

(58) Field of Classification Search
USPC ..... 451/43, 44, 57, 58, 65, 66, 67, 190, 451/194, 195, 262, 362, 365, 384, 385, 397, 451/913
See application file for complete search history.

(56) References Cited

U.S. PATENT DOCUMENTS

| | | | | |
|---|---|---|---|---|
| 4,375,738 | A * | 3/1983 | Bando | 451/4 |
| 5,117,590 | A * | 6/1992 | Kudo et al. | 451/44 |
| 5,613,894 | A * | 3/1997 | Delle Vedove | 451/1 |
| 5,993,295 | A | 11/1999 | Raffaelli | |
| 6,306,016 | B1 * | 10/2001 | Steere et al. | 451/44 |
| 6,336,057 | B1 * | 1/2002 | Obayashi | 700/164 |
| 6,371,835 | B1 * | 4/2002 | Flisram et al. | 451/48 |
| 6,604,984 | B2 * | 8/2003 | Gariglio | 451/5 |
| 6,913,520 | B1 * | 7/2005 | Liao et al. | 451/41 |
| 7,001,249 | B1 * | 2/2006 | Pride et al. | 451/21 |
| 2004/0029496 | A1 * | 2/2004 | Mizuno et al. | 451/43 |
| 2005/0202754 | A1 | 9/2005 | Bechtold et al. | |

FOREIGN PATENT DOCUMENTS

| | | |
|---|---|---|
| CN | 101407032 | 4/2009 |
| WO | 95/09714 | 4/1995 |
| WO | 01/94072 | 12/2001 |

* cited by examiner

*Primary Examiner* — Timothy V Eley
(74) *Attorney, Agent, or Firm* — Womble Carlyle Sandridge & Rice LLP

(57) ABSTRACT

A complex geographical edge finishing system includes a fixture that holds an external part having a complex three-dimensional edge, a track disposed around the fixture and surrounding the edge of the part held in the fixture, and one or more finishing apparatuses that can sand, polish, buff, paint and/or apply coatings to the complex three-dimensional edge. The finishing apparatuses move about the track such that the three-dimensional edge of the part can be polished. The path of the track can substantially match, mimic or otherwise correspond to the path of the three-dimensional edge, such that special requirements for the finishing apparatuses are not required.

19 Claims, 6 Drawing Sheets

COMPLEX GEOGRAPHICAL EDGE POLISHING

CROSS REFERENCE TO RELATED APPLICATION

This application claims priority to U.S. Provisional Patent Application No. 61/249,200, filed Oct. 6, 2009, and entitled "COMPLEX GEOGRAPHICAL EDGE POLISHING," which is incorporated herein by reference in its entirety and for all purposes.

TECHNICAL FIELD

The present invention relates generally to the manufacture of consumer devices, and more particularly to the automated finishing of complex edges or profiles on such consumer devices.

BACKGROUND

New and improved consumer devices and components are constantly being introduced and provided in the marketplace. To stay competitive, designs for various consumer devices or products, such as handheld or hand manipulated devices, for example, should meet or exceed consumer expectations for numerous factors, such as cost, weight, functionality, outward appearance, texture and distinctiveness with respect to competing devices or products, among others. One industry where such considerations are particular relevant is the electronics or computing industry, although applications within many others industries can certainly apply as well. When it comes to designing, making and marketing handheld electronic devices and components, aesthetic appeal and distinctiveness can be at a premium.

Particular areas that command attention from consumer product designers and manufacturers can include overall device shape and profile, as well as surface finish or texture. In many applications, relatively complex shapes or profiles for a consumer product or product component can be advantageous with respect to both aesthetic appeal and distinctiveness from the products of competitors. The shape and profile of a Coca-Cola® bottle is a classic example of a handheld consumer product that is aesthetically appealing and also distinctive with respect to counterpart items provided by the competition.

Unfortunately, relatively complex shapes or profiles can limit the ability of a manufacturer to also provide a particularly desirable surface texture or finish for an outer region of such a consumer product or component. Hence, one drawback to designing consumer products having distinctively complex shapes or profiles is the ability to provide a suitably appealing surface texture or finish for the complex region or profile on the item. In particular, complex or irregular surface regions can hinder the ability to sand, polish, buff, paint, apply a coating, or otherwise provide a nice surface finish. In many cases, the use of a complex shape or profile for a consumer product, and particularly a handheld or hand operated product, can result in the need for costly and inconsistent manual finishing processes for such a product.

While many designs and methods of manufacture for providing surface finishes on complex or irregular outer regions of handheld items and other consumer product components have generally worked well in the past, there is always a desire to provide new and improved designs and techniques that result in aesthetically pleasing and consistent outer surface finishes for complex surface regions of such components while also streamlining and automating the manufacturing process, such that more distinctive complex shapes and profiles can be used.

SUMMARY

It is an advantage of the present invention to provide an automated finishing system that conducts finishing operations on a consumer product component having at least one edge with a complex profile. Such complex geographical edge polishing or finishing can be accomplished at least in part through the use of an automated finishing system that is specifically designed to account for the complex profile or profiles on the consumer product component during the finishing process.

In various embodiments, an automated finishing system can include a fixture adapted to effect a hold an external part having a three-dimensional or complex edge portion, a track disposed around the fixture and arranged to be proximate to the three-dimensional edge portion when the external part is held as a result of the fixture, and one or more finishing apparatuses that include one or more rotating finishing members. The three-dimensional edge portion can defines a path that travels in each of three mutually orthogonal x, y and z directions, and the path of the track can travel in each of the x, y and z directions in a manner that substantially mimics or otherwise corresponds to the path of the three-dimensional edge portion. The one or more finishing apparatuses can move about the track such that the three-dimensional or complex edge of the part can be finished in a consistent and automated fashion. Such a finishing process can be a polishing process, although sanding, buffing, painting and other coating processes may also be used.

In various detailed embodiments, the track surrounds the three-dimensional edge portion of the external part when the external part is held as a result of the fixture. In various embodiments, the one or more finishing apparatuses can include one or more rotating polishing members. The finishing apparatuses can move along the track simultaneously while the one or more finishing members or components are acting upon the three-dimensional edge portion. In various embodiments, at least a portion of the three-dimensional edge portion path includes a continuous change in each of the x, y and z dimensions. In addition, the three-dimensional edge portion path can define a closed loop, and/or can extend away from the remaining surfaces of the external part, which can be, for example, a computing device component, such as a mouse or portion of a mouse.

Further finishing system components can include a tool adapted to interface with the external part to form a combined tool and external part component, wherein the tool is directly held by the fixture to result in an indirect hold on the external part. In addition, the finishing system can include a clamping component adapted to clamp the combined tool and external part component against said fixture during the finishing process.

In various further embodiments, a method of finishing a consumer product component can include the steps of holding the consumer product component in or about a fixture, positioning a track around at least a portion of the fixture, disposing one or more finishing devices on or about said track, performing one or more finishing operations with the one or more finishing devices, and moving the one or more finishing devices about the track after the beginning of but before the end of the performing step. The consumer product component can have at least one edge portion with a complex profile, and this can be the part of the consumer product upon which the one or more finishing devices perform a finishing process. The track can have a particular path that reflects the nature of the complex profile edge of the consumer product component, such as a path shape that mimics the shape or profile of the complex profile edge. Again, the finishing process can be a polishing process, although sanding, buffing, painting and other coating processes may also apply.

In some embodiments, the performing and moving steps are conducted simultaneously. Alternatively, the one or more finishing devices can be moved about the track in iterations, with the actual finishing processes being conducted while the devices are stopped at the various track iterations. In some embodiments, the holding step includes clamping the consumer product component against the fixture. Such clamping can be conducted during the performing step. Again, the consumer product component can be a computing device component, such as a mouse or mouse portion.

In various embodiments, an apparatus can include a body having an outer surface and at least one edge portion comprising a complex profile disposed about and extending away from or rising above the outer surface. The at least one edge portion can include a surface having a finish that was provided by an automated finishing system. Such an automated finishing system can have a track with a path that reflects the nature of the complex profile edge and one or more finishing devices that move about said track as part of the finishing process.

Other apparatuses, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and arrangements for the disclosed inventive apparatus and method for providing complex geographical edge polishing. These drawings in no way limit any changes in form and detail that may be made to the invention by one skilled in the art without departing from the spirit and scope of the invention.

DETAILED DESCRIPTION

Exemplary applications of apparatuses and methods according to the present invention are described in this section. These examples are being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following examples should not be taken as limiting.

In the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting; such that other embodiments may be used, and changes may be made without departing from the spirit and scope of the invention.

The invention relates in various embodiments to the design and manufacture of consumer devices having complex edge or profile regions. Such consumer devices can include handheld or hand operated devices, such as portable or otherwise hand operated electronic or computing devices or components, among other suitable items. In particular, the present invention relates to the automated and reliable finishing of various complex edge or profile regions on such products. Such products can be, for example, computing device components. In a particular example, such as that which is provided herein for purposes of illustration, such products can include a computer mouse or portion of a mouse. Of course, numerous other products can have surface finishing applied as described by the systems and methods disclosed herein, and it is contemplated that such systems and methods can be used on a wide variety of suitable products and devices.

Figure 1:
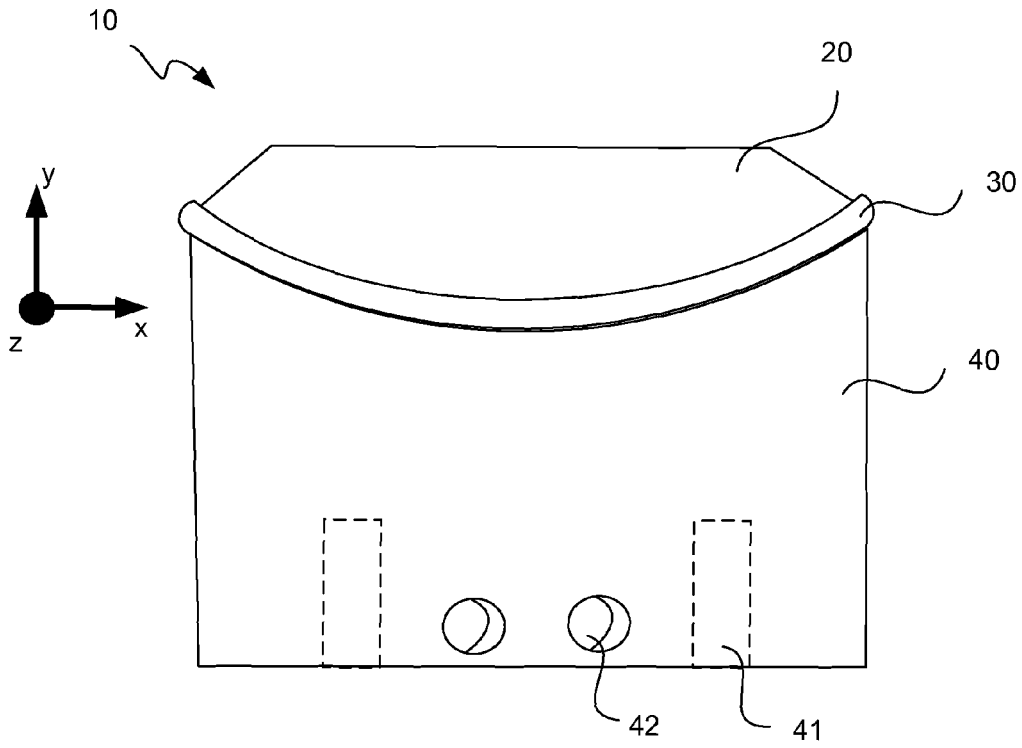
FIG. 1 illustrates in side elevation view an exemplary consumer product having an edge with a complex profile according to one embodiment of the present invention.

Referring first to FIG. 1, an exemplary consumer product having an edge with a complex profile is illustrated in side elevation view according to one embodiment of the present invention. Consumer product 10 can be any of a wide variety of products, items or components, such as, for example, a handheld electronic device. Consumer product 10 can include a top 20, a raised complex profile edge 30, and a base 40, among other possible components. Vertical mounting holes 41 may extend into the base 40 of consumer product 10, and horizontal holes 42 may also extend from one side of the product to the other. In some embodiments, top 20 may be removable from base 40, and complex edge 30 can attach to top 20 or base 40. In some embodiments, both top 20 and base 40 can have their own attached raised and complex edge portion 30.

Alternatively, base 40 can comprise a tool that is separate from the rest of consumer product 10. For example, consumer product 10 can comprise an inversely positioned computer mouse having a bottom portion 20, complex raised edge 30 adapted to be gripped by a user, and an upper surface that interfaces against the top surface of the base or tool 40. The base or tool 40 is adapted to interface with and fit loosely against the consumer product 10 to form a combined tool and product component or combination, such that the tool can be directly held by a fixture to result in an indirect hold on the consumer product, as set forth in greater detail below.

Consumer product 10 is shown in FIG. 1 with respect to three orthogonal axes, x, y and z. Complex profile edge 30 can be raised above the outer surfaces of both top 20 and base 40, and this complex edge can form a continuous curve that does not remain constant for any significant portion with respect to any of three orthogonal axes x, y and z. That is, as one follows the path defined by edge 30, the edge itself is always or usually varying in direction along all three axes. Such continuous or frequent multidirectional variances can result in an overall complex edge or profile of a component that can be relatively difficult to manufacture and/or to finish precisely and consistently in a mass-manufacturing setting.

Figure 2:
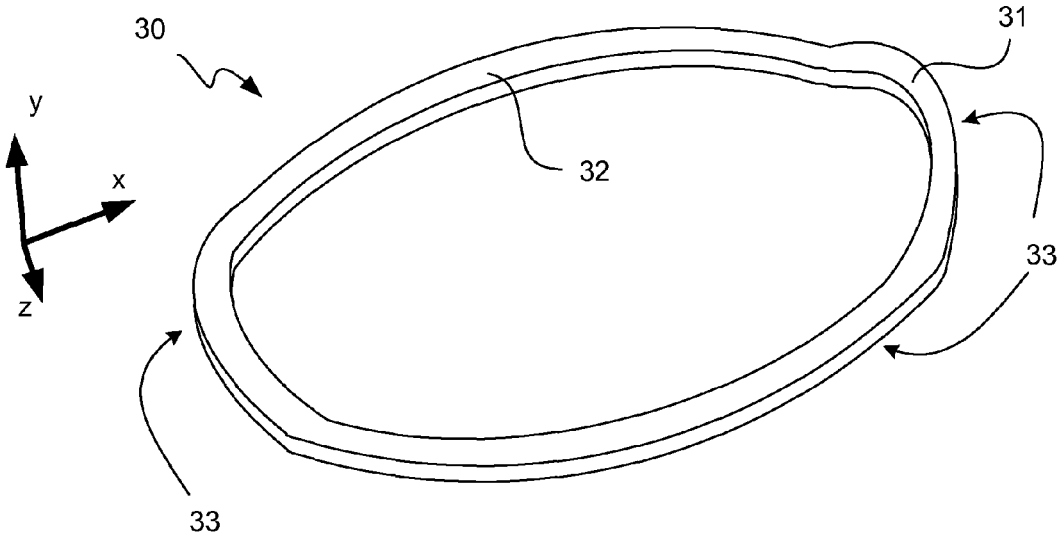
FIG. 2 illustrates in top perspective view an exemplary isolated complex profile edge from the consumer product of FIG. 1 according to one embodiment of the present invention.

Turning next to FIG. 2, an exemplary isolated complex profile edge from the consumer product of FIG. 1 is shown in top perspective view. As will be readily understood, complex profile edge 30 is being shown in isolation for purposes of illustration, and it is not necessary that such a complex raised edge or other complex shape or profile component be separable from consumer product 10. For purposes of reference with respect to FIG. 1, an adjusted x/y/z axes indicator is also provided. Complex edge 30 can have a continuous curvature that results in one or more relatively high regions 31 and one or more relatively low regions 32. At some or all of these regions, an outermost region 33 of the raised profile or edge 30 can be designated for one or more finishing processes. Such outermost regions 33 to be finished can exist in continuous looped fashion around an outer circumference of edge 30. Alternatively, one or more outermost regions can be isolated or segmented (not shown) with respect to each other and/or other product components.

Although the various embodiments provided herein focus on a polishing process as a finishing process of interest, it will be readily appreciated that one or more additional or separate manufacturing and/or finishing processes may be used instead of or in addition to a polishing process. Any and all such alternative processes may be accomplished though the same or similar measures set forth herein with respect to an automated polishing or finishing system. Alternative finishing processes can include, for example, sanding, buffing, painting, and applying a coating to a complex geographical edge or edge portion, among others possible processes.

Figure 3:
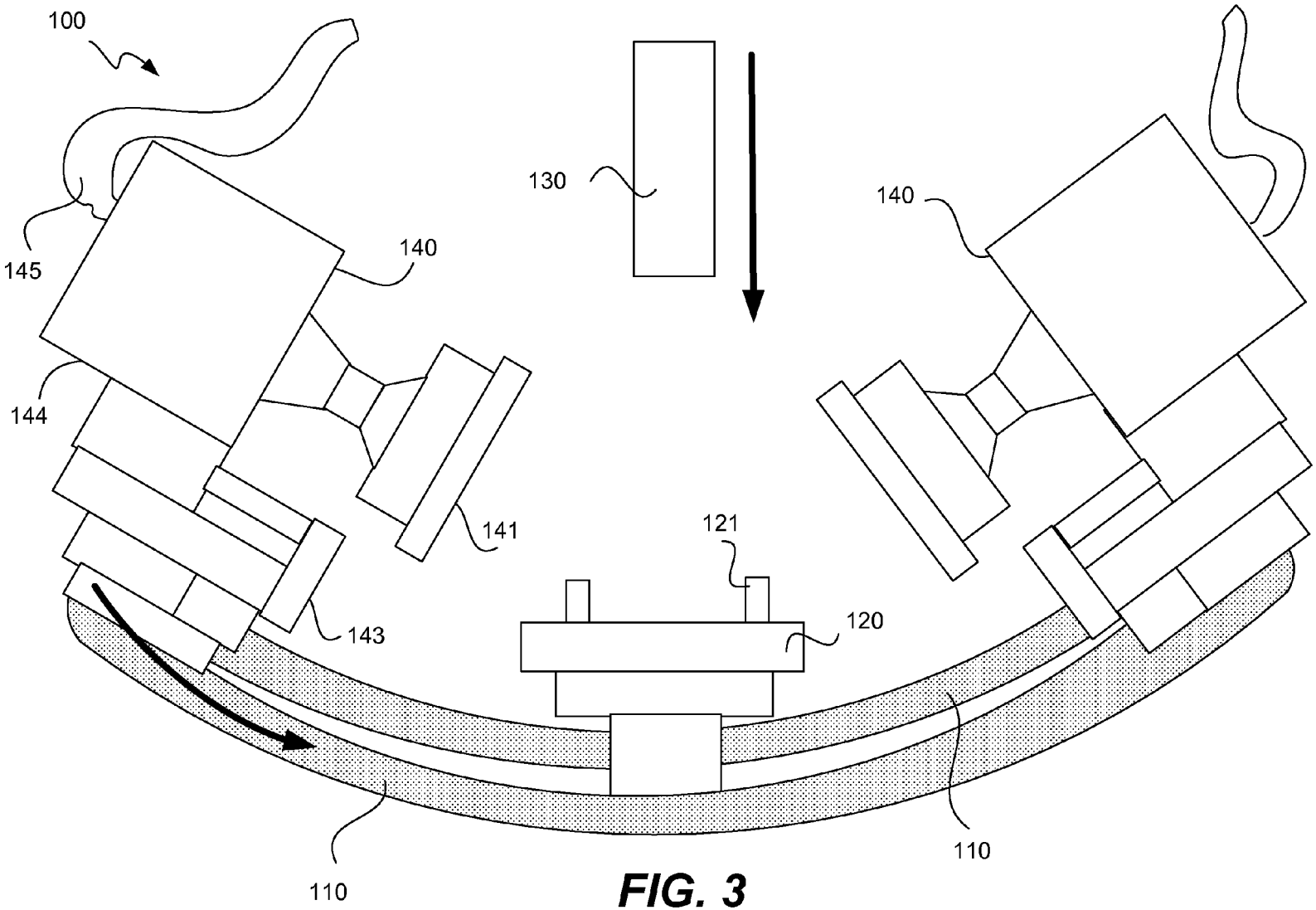
FIG. 3 illustrates in side elevation view an exemplary automated polishing system adapted to polish the complex profile edge of the consumer product of FIG. 1 according to one embodiment of the present invention.

Moving now to FIG. 3, an exemplary automated polishing system adapted to polish the complex profile edge of the consumer product of FIG. 1 according to one embodiment of the present invention is shown in side elevation view. Automated polishing system 100 can include a number of significant components, such as a specialized track 110, a fixture 120 having one or more pins 121 or other coupling components adapted to hold a computer product to be finished, a retractable top clamp 130, and one or more polishing apparatuses 140. Each of the one or more polishing apparatuses 140 can include a number of components, such as a rotating polishing member 141, a rotating support 142, a mobile base 143, a body 144 and an associated connector or tube 145 that can provide any of a number of things to the polishing apparatus.

Polishing member 141 can be adapted to contact and polish at least a portion of a consumer product. As will be readily appreciated, a number of items can be substituted for polishing member 141 for alternative finishing applications. For example, a sanding wheel, buffing unit, paint dispenser or coating applicator might be used instead of polishing member 141. Rotating support 142 provides support and transmits rotational energy from an internal engine (not shown) to the polishing member 141. The entire polishing apparatus can be mounted to a mobile base 143 that is adapted to move about an associated track 110. Body 144 can house a motor that provides rotational energy to the rotating support 142 and polishing member 141. A flexible connector or tube 145 can be used to contain and direct various wirings and/or other materials, such as paint or another coating, to the finishing member 141 that interfaces with the consumer product. Such wirings can include, for example, power and ground for the motor, as well as a communications cable for relaying instructions from a computer system or device (not shown).

Such a computer or other automated control system or device can be used to help implement the automated nature of polishing system 100. For example, one or more computer programs and/or settings can be used to control the positioning, speed, movement and other desired factors for the functions of the polishing members 141 associated driving motors, and mobile bases 143, among other moving parts.

Of particular interest can be the specialized track 110. While the various polishing apparatus 140 or other similar finishing devices can operate in a relatively simple and straightforward manner, the particular design of the track 110 can help to result in a finishing process having increased efficiency for a given consumer product with a complex edge or profile portion. In particular, the track 110 can be shaped or otherwise formed to have a path that reflects or substantially corresponds to path defined by the complex profile edge on the consumer product of interest. That is, the curvature or path of track 110 can mimic the curvature or path found on complex profile edge 30 of product 10. As shown in various perspectives in FIGS. 4A through 6B, track 110 follows a continuous curved path that is substantially similar in nature to the complex profile edge 30 that the polishing device is designed to polish. As such, a more reliable and controlled polishing process on such an irregular or complex edge or profile shape can be accomplished.

Figure 4A:
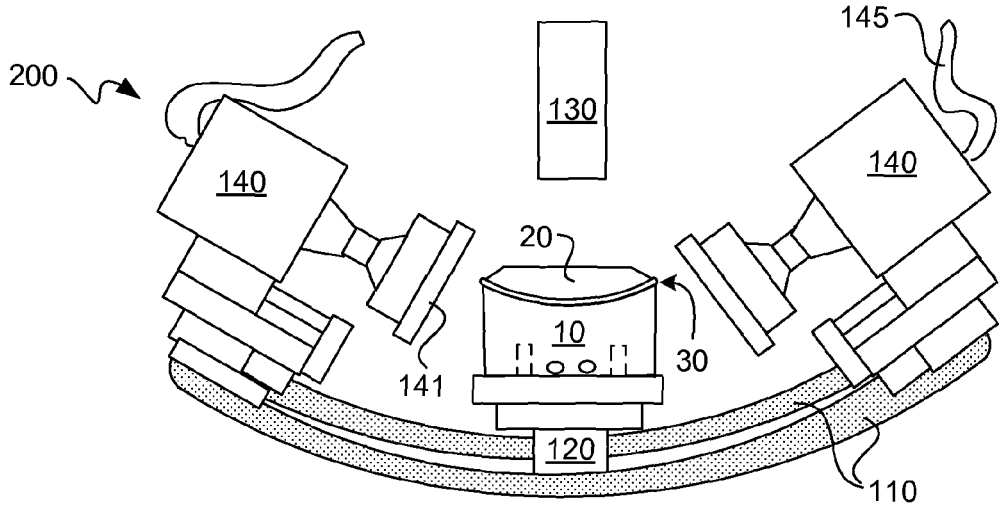
FIG. 4A illustrates in side elevation view the exemplary automated polishing system of FIG. 3 with the consumer product of FIG. 1 mounted therein according to one embodiment of the present invention.

Continuing now with FIGS. 4A through 6B, automated polishing system 100 is shown in side elevation view in various stages of operation with respect to a subject consumer product 10 installed therein. FIG. 4A illustrates the exemplary automated polishing system of FIG. 3 with the consumer product of FIG. 1 mounted therein. Stage 200 reflects the state of system 100 right after the mounting of consumer product 10 to fixture 120, but before any other components have been moved or actuated. Again, consumer product 10 can have a top 20 and a raised complex edge portion 30 that traverses the entire circumference of product 10, while one or more polishing members 141 attached to one or more polishing apparatuses 140 can be positioned with respect to the complex edge portion.

Figure 4B:
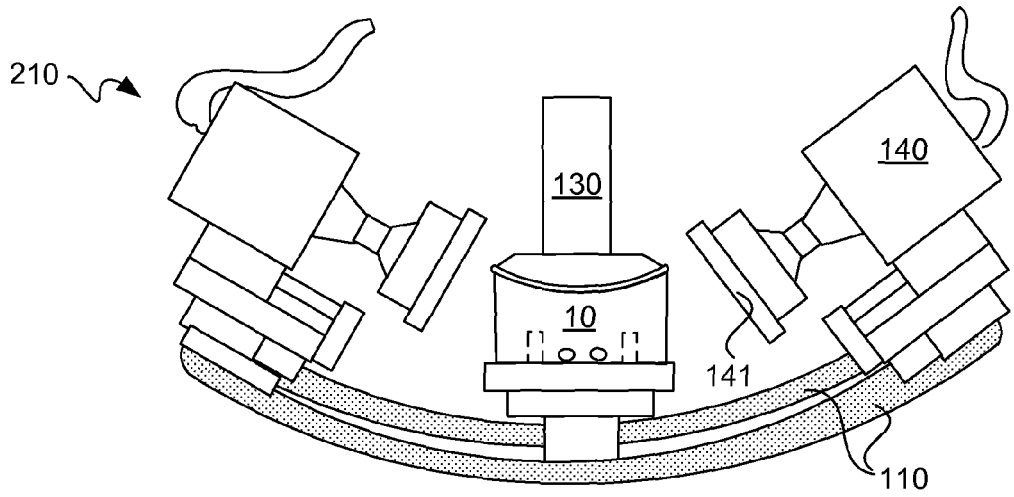
FIG. 4B illustrates in side elevation view the exemplary automated polishing system of FIG. 4A with a top clamp lowered to hold the consumer product in place according to one embodiment of the present invention.

FIG. 4B illustrates a subsequent stage 210, with that being the state of exemplary automated polishing system 100 of FIG. 4A with top clamp 130 being lowered to hold the consumer product 10 in place on fixture 120. Of course, other suitable clamping and/or affixing apparatuses or arrangements may be used to hold consumer product 10 in place for the subject finishing operation or operations.

Figure 4C:
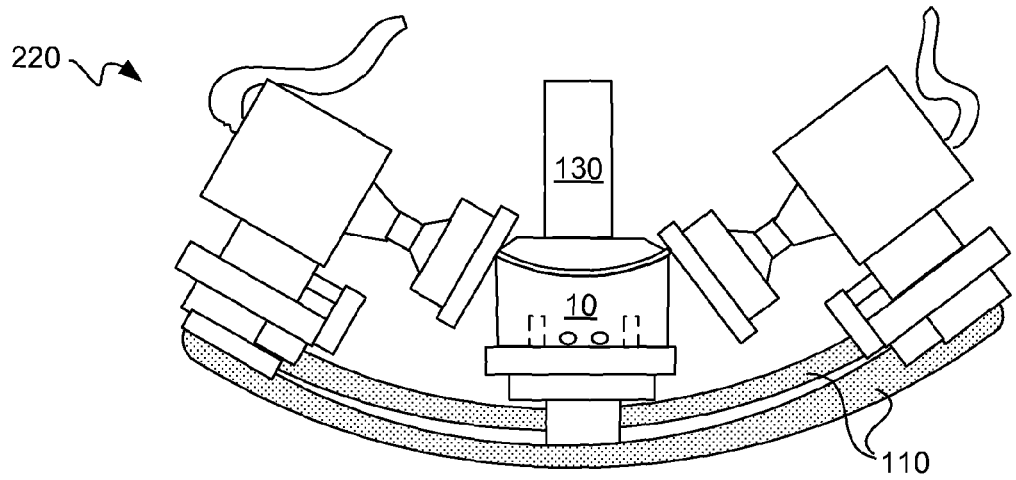
FIG. 4C illustrates in side elevation view the exemplary automated polishing system of FIGS. 4A and 4B with a plurality of polishing members extended from a plurality of polishing apparatuses to polish the complex profile edge of the consumer product according to one embodiment of the present invention.

FIG. 4C illustrates a subsequent stage 220, with that being the state of exemplary automated polishing system 100 of FIGS. 4A and 4B with one or more polishing members 141 being extended from one or more polishing apparatuses 140 to polish the complex profile edge 30 of the consumer product 10. As such, polishing members 141 actually make contact with the edge 30, and can begin the polishing or other suitable finishing process. Polishing apparatuses 140 can then be adapted to move about track 110 such that the entire complex profile edge 30 gets polished. In the even that two polishing apparatus 140 are used, each can be designed to traverse a half rotation about the outside of consumer product 10. At such a point, the polishing process may be deemed as finished. Alternatively, the two polishing apparatuses may reverse direction, or may continue to orbit around the consumer product in the same direction as they started.

Figure 5A:
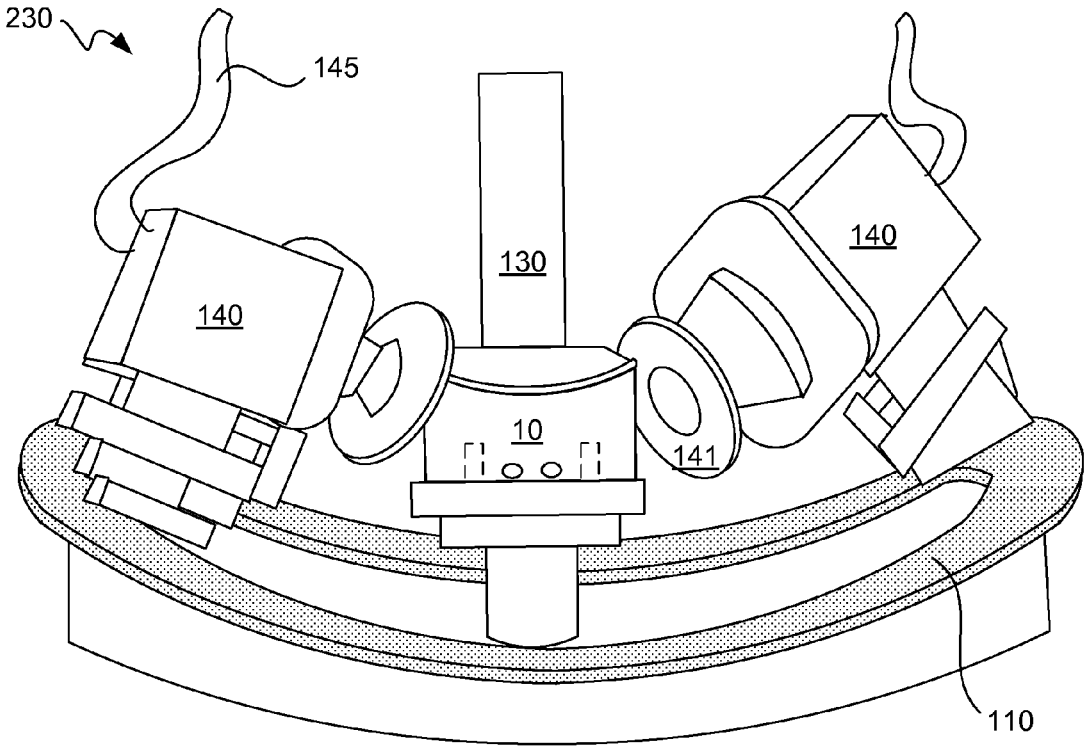
FIG. 5A illustrates in side elevation view the exemplary automated polishing system of FIGS. 4A-4C with the plurality of polishing apparatuses having begun to move along an associated track while polishing the complex profile edge of the consumer product according to one embodiment of the present invention.

FIG. 5A illustrates a subsequent stage 230, with that being the state of exemplary automated polishing system 100 of FIGS. 4A-4C, only with the plurality of polishing apparatuses 140 having begun to move along associated track 110 while remaining in contact with and polishing the complex profile edge 30 of the consumer product 10. As shown, two polishing apparatuses 140 have both begun to traverse track 110 in a rotational direction around the outside of consumer product 10. Although two polishing apparatuses 140 are shown for purposes of illustration, it will be readily appreciated that more or fewer such apparatus can be used. For example, a single polishing apparatus 140 can be designed to traverse the entire circumference of complex edge 30 while polishing the edge.

Figure 5B:
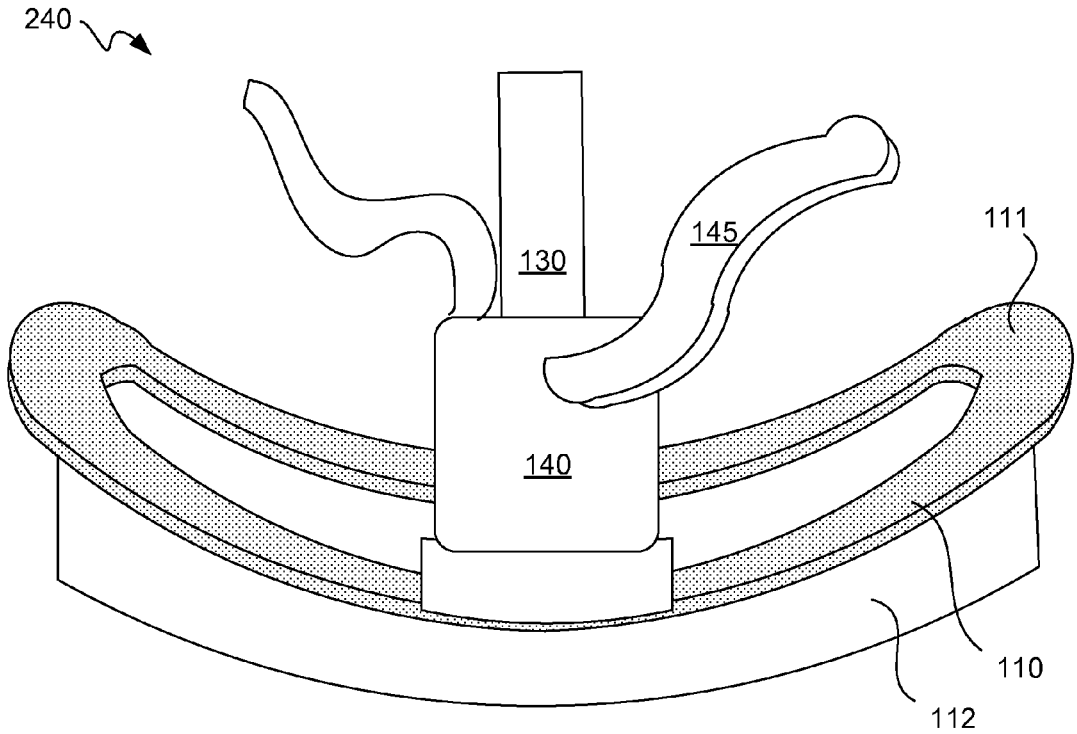
FIG. 5B illustrates in side elevation view the exemplary automated polishing system of FIG. 5A with the plurality of polishing apparatuses having moved further along the associated track to a lowest position of the track while polishing the complex profile edge of the consumer product according to one embodiment of the present invention.

FIG. 5B illustrates a subsequent stage 240, with that being the state of exemplary automated polishing system 100 of FIG. 5A, only with the plurality of polishing apparatuses 140 having moved further along the associated track 110 to a lowest position of the track possible for the polishing apparatuses. It will be appreciated that both polishing apparatuses 140 can traverse the entire paths taken from FIG. 4C to FIG. 5B while polishing complex profile edge 30 at all times during the moving process. As shown, each of polishing apparatus 140 has progressed at or about 90 degrees of a full 360 degree circle or orbit about stationary consumer product 10. Alternatively, one or more polishing apparatuses 140 may move some distance along the specific path of track 110 and then stop to polish a local region or portion of edge 30. This process can then be repeated along any number of stops between the start and finish positions of polishing apparatuses 140 on track 110. In this manner, a full polishing of edge 30 can be accomplished without performing any actual polishing when the polishing apparatuses are moving along the track.

FIG. 5B also provides particular perspective with respect to at least a portion of specialized track 110. As shown, track 110 can include an upper surface 111 that is supported by a lower base 112. Upper surface 111 can be formed as part of an upper flange that extends laterally beyond the sides of lower base or bottom portion 112. Overall, the cross-sectional shape of track 110 can lend itself to the ready traversal of one or more finishing devices along its path. Again, the path of the track 110 can be specifically designed to reflect or even mimic the various properties of the complex profile or edge 30 of the device being polished or finished. By taking care to design the track in such a manner, the motion and traversal of the one or more polishing devices can follow right along with the irregular or otherwise complex nature of the edge 30.

Figure 6A:
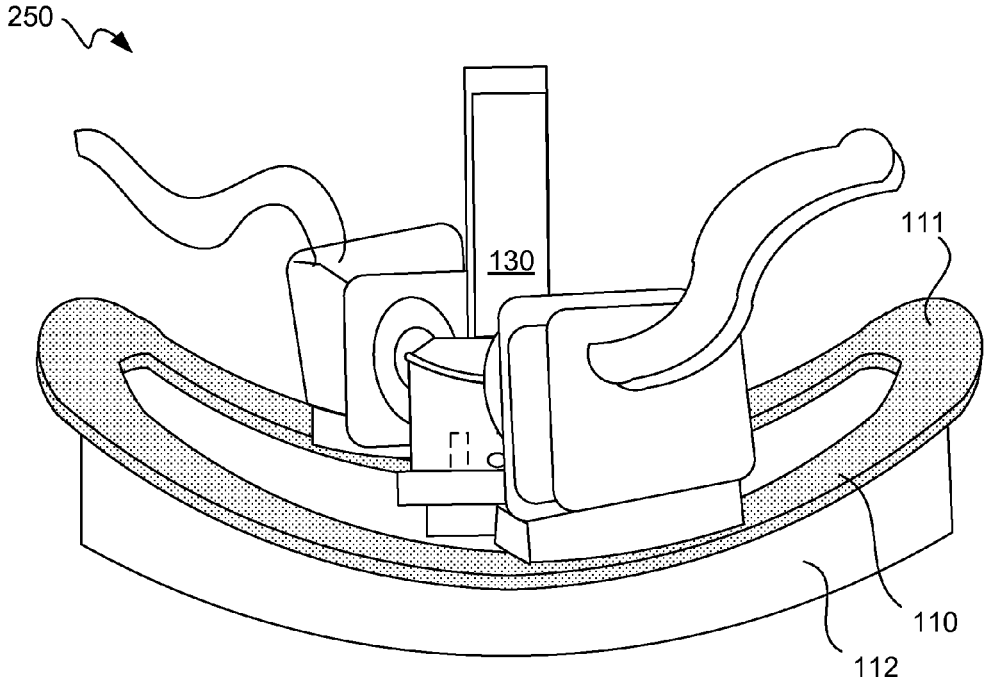
FIG. 6A illustrates in side elevation view the exemplary automated polishing system of FIG. 5B with the plurality of polishing apparatuses having moved even further along the associated track to begin ascending an upward portion of the track while polishing the complex profile edge of the consumer product according to one embodiment of the present invention.
Figure 6B:
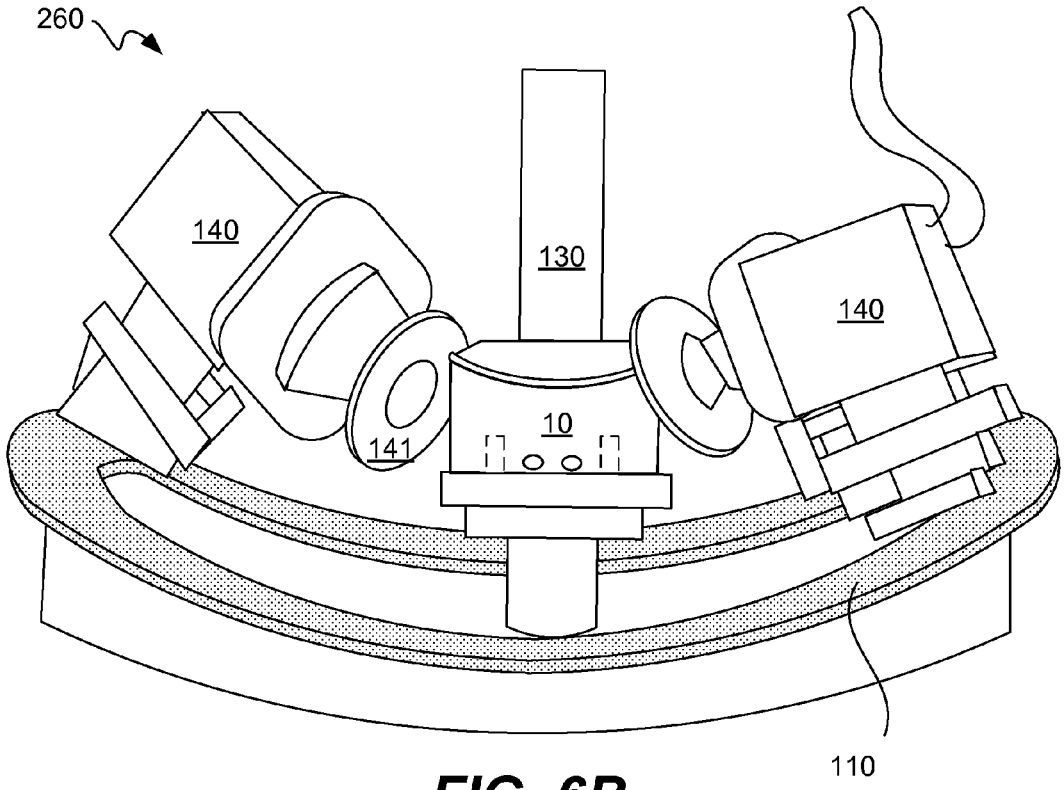
FIG. 6B illustrates in side elevation view the exemplary automated polishing system of FIG. 6A with the plurality of polishing apparatuses having moved still further along the associated track and ascended along an upward portion of the track such that the polishing apparatus are tilted while still polishing the complex profile edge of the consumer product according to one embodiment of the present invention.

FIG. 6A illustrates a subsequent stage 250, with that being the state of exemplary automated polishing system 100 of FIG. 5B with the plurality of polishing apparatuses 140 having moved even further along the associated track 100 to begin ascending an upward portion of the track while polishing the complex profile edge 30 of the consumer product 10 according to one embodiment of the present invention. Continuing further, FIG. 6B illustrates a subsequent stage 260, with that being the state of exemplary automated polishing system 100 of FIG. 6A with the plurality of polishing apparatuses 140 having moved still further along the associated track 110 and having ascended along an upward portion of the track such that the polishing apparatuses are tilted while still polishing the complex profile edge 30 of the consumer product 10. As will be readily appreciated, the polishing apparatuses 140 can then continue onward to reach a full 180 degree traversal of track 110 since the starting point shown in FIG. 4C. In this manner, the entire complex profile edge 30 can be polished along its entirety by polishing apparatuses 140.

As will be readily appreciated, numerous additional degrees of freedom may be introduced into system 100 in order to maximize the efficiency of the automated system. For example, polishing members 141 may have a certain degree of flexibility in one or more directions with respect to their respective attached rotating supports 142. In addition, the entire body 144 of a polishing apparatus 140 can be adapted to pivot and/or rotate about its respective mobile base 143 in a controlled manner, such that fine tuned polishing or finishing of the complex edge 30 can be accomplished. Such added degrees of freedom may be robotically controlled by an associated computer or other controller, which may be located remotely from the rest of the system, such as via connections through flexible tube 145.

Figure 7:
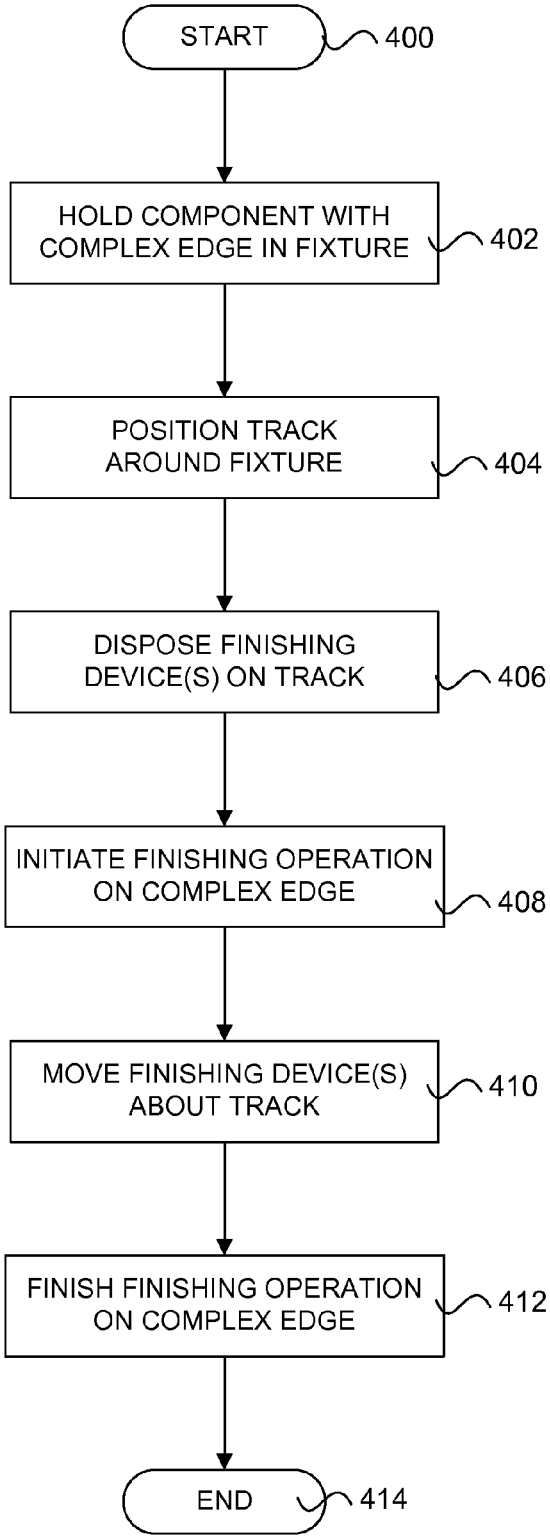
FIG. 7 presents a flowchart of an exemplary method of finishing a consumer product according to one embodiment of the present invention.

Turning lastly to FIG. 7, a flowchart of an exemplary method of polishing or otherwise performing a finishing process on a consumer product according to one embodiment of the present invention is provided. While the provided flowchart may be comprehensive in some respects, it will be readily understood that not every step provided is necessary, that other steps can be included, and that the order of steps might be rearranged as desired by a given device manufacturer, vendor or user. For example, step 402 may alternatively be performed after steps 404 and/or 406, since these steps 404 and 406 might be considered to involve the formation of the polishing system itself, after which individual products may then be polished during a manufacturing process.

After start step 400, a user can position a component having a complex edge feature, such as consumer product or part thereof, to be held in a fixture at process step 402. At subsequent process step 404, a specialized track can be positioned around the fixture that holds the consumer product or part of interest. Again, such a positioning might be accomplished prior to the placement of a part to be polished into the fixture, such as where a large permanently installed track is provided with respect to a given fixture. At a following process step 406, one or more finishing devices can be disposed on or about the track. Such finishing devices can be, for example, the polishing apparatuses 140 that are described in greater detail above. Again, this step may be accomplished prior to step 402, if desired.

The method then continues to process step 408, where a finishing operation is initiated with respect to the consumer product held in the fixture. At subsequent process step 410, the finishing device or devices are moved about the track, such as in an orbit of the fixture and product being finished. After one or more movements of finishing devices about the track, the method then proceeds to process step 412, where the subject finishing operation on the complex edge is finished. In some embodiments, this can result in steps 408 and 410 being performed at the same time, since the finishing procedure can be performed continuously while the one or more finishing devices are orbiting or otherwise rotating about the consumer product. The method then ends at end step 410.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. An automated polishing system, comprising:

a fixture adapted to effect a hold on an external part having a three-dimensional edge portion, wherein the three-dimensional edge portion defines a path that travels in each of three mutually orthogonal x, y and z directions;

a track disposed around the fixture and arranged to be proximate to the three-dimensional edge portion of the external part when the external part is held by the fixture, wherein a track path of said track travels in each of x, y and z directions and substantially corresponds to the path of the three-dimensional edge portion; and one or more polishing apparatuses adapted to polish the three-dimensional edge portion of the external part, wherein said one or more polishing apparatuses move along said track as part of a polishing process.

2. The polishing system of claim 1, wherein said track surrounds the three-dimensional edge portion of the external part when the external part is held by the fixture.

3. The polishing system of claim 1, wherein said one or more polishing apparatuses include one or more rotating polishing members.

4. The polishing system of claim 3, wherein said one or more polishing apparatuses move along said track simultaneously with the one or more rotating polishing members rotating and polishing the three-dimensional edge portion.

5. The polishing system of claim 1, wherein at least a portion of the three-dimensional edge portion path includes a continuous change in each of the x, y and z dimensions.

6. The polishing system of claim 1, wherein the three-dimensional edge portion path defines a closed loop.

7. The polishing system of claim 1, wherein the polishing system is adapted to polish only the three-dimensional edge portion of the external part during a polishing process.

8. The polishing system of claim 1, further including:

a tool adapted to interface with said external part to form a combined tool and external part component, wherein said tool is directly held by said fixture to result in an indirect hold on the external part.

9. The polishing system of claim 8, further including:

a clamping component adapted to clamp the combined tool and external part component against said fixture during the polishing process.

10. The polishing system of claim 1, wherein the external part comprises a computing device component.

11. A surface finishing system, comprising:

a fixture adapted to hold an external part having a three-dimensional edge portion, wherein the three-dimensional edge portion defines a path that moves in each of three mutually orthogonal x, y and z directions;

a track disposed around the fixture and arranged to be proximate to the three-dimensional edge portion of the external part when the external part is held by the fixture, wherein a track path of said track moves in each of x, y and z directions substantially corresponding to the path defined by the three-dimensional edge portion; and one or more surface finishing apparatuses adapted to affect the three-dimensional edge portion of the external part, wherein said one or more surface finishing apparatuses move along said track as part of a finishing process.

12. The surface finishing system of claim 11, wherein said one or more surface finishing apparatuses are adapted to sand, polish, buff, paint, or any combination thereof.

13. The surface finishing system of claim 11, wherein each of the one or more surface finishing apparatuses are adapted to rotate about a mobile base.

14. The surface finishing system of claim 11, wherein at least a portion of the three-dimensional edge portion path includes a continuous change in each of the x, y and z dimensions.

15. A surface finishing system, comprising:

a fixture adapted to secure a workpiece having a three-dimensional edge, wherein the three-dimensional edge defines a three-dimensional path that travels in each of three mutually orthogonal x, y and z directions;

a track comprising:

a rigid structure disposed around the fixture and arranged to be proximate to the three-dimensional edge when the workpiece is secured by the fixture, wherein the rigid structure has a continuous curved surface that substantially corresponds to the three-dimensional path of the three-dimensional edge, an opening disposed in a central region of the rigid structure and configured to accommodate the secured workpiece therein; and a surface finishing device adapted to finish the three-dimensional edge of the workpiece, wherein the surface finishing device moves along the track during a finishing process.

16. The surface finishing system of claim 15, wherein the surface finishing system comprises more than one surface finishing device.

17. The surface finishing system of claim 16, wherein the surface finishing system is configured to allow the surface finishing devices to move along the track simultaneously during the finishing process.

18. The surface finishing system of claim 15, further comprising:

a base structure disposed under and configured to support the rigid structure during the finishing process.

19. The surface finishing system of claim 15, wherein the rigid structure is configured to allow the finishing device to move about the track and finish the three-dimensional edge using an automated system.

* * * * *

UNITED STATES PATENT AND TRADEMARK OFFICE

CERTIFICATE OF CORRECTION

PATENT NO. : 8,690,640 B2
APPLICATION NO. : 12/833923
DATED : April 8, 2014
INVENTOR(S) : Thomas Johannessen It is certified that error appears in the above-identified patent and that said Letters Patent is hereby corrected as shown below:

In the Claims

Column 9, line 58 (Claim 5, line 2): "three-dimensional edge portion path" should read --path of the three-dimensional edge portion--

Column 9, lines 60-61 (Claim 6, lines 1-2): "three-dimensional edge portion path" should read --path of the three-dimensional edge portion--

Signed and Sealed this
Fifteenth Day of July, 2014

Michelle K. Lee

Michelle K. Lee
*Deputy Director of the United States Patent and Trademark Office*